United States Patent [19]

Gramelspacher

[11] Patent Number: 4,712,731

[45] Date of Patent: Dec. 15, 1987

[54] MAIL BOX STRUCTURE

[76] Inventor: George W. Gramelspacher, 3955 Frankfurt St., Jasper, Ind. 47546

[21] Appl. No.: 888,120

[22] Filed: Jul. 22, 1986

[51] Int. Cl.[4] ..... B65D 91/00

[52] U.S. Cl. ..... 232/17

[58] Field of Search ..... 232/17; 109/49.5

[56] References Cited

U.S. PATENT DOCUMENTS 2,326,713 8/1943 Wessler ..... 109/49.5 X 3,848,508 11/1974 Bullinger ..... 109/49.5 X 4,375,869 3/1983 Hatch ..... 232/17

*Primary Examiner*—Robert W. Gibson, Jr.

*Attorney, Agent, or Firm*—Warren D. Flackbert

[57] ABSTRACT

A rural or suburban mail box structure characterized by a housing, or body, wrapped or overlaid with a thin decorative exterior grade and preservative treated flexible plywood. The arrangement of the invention effectively satisfies both durability and appearance purposes, representing a finished product/effect not available heretofore, where the employed flexible plywood is dimensionally stable and strong.

5 Claims, 3 Drawing Figures

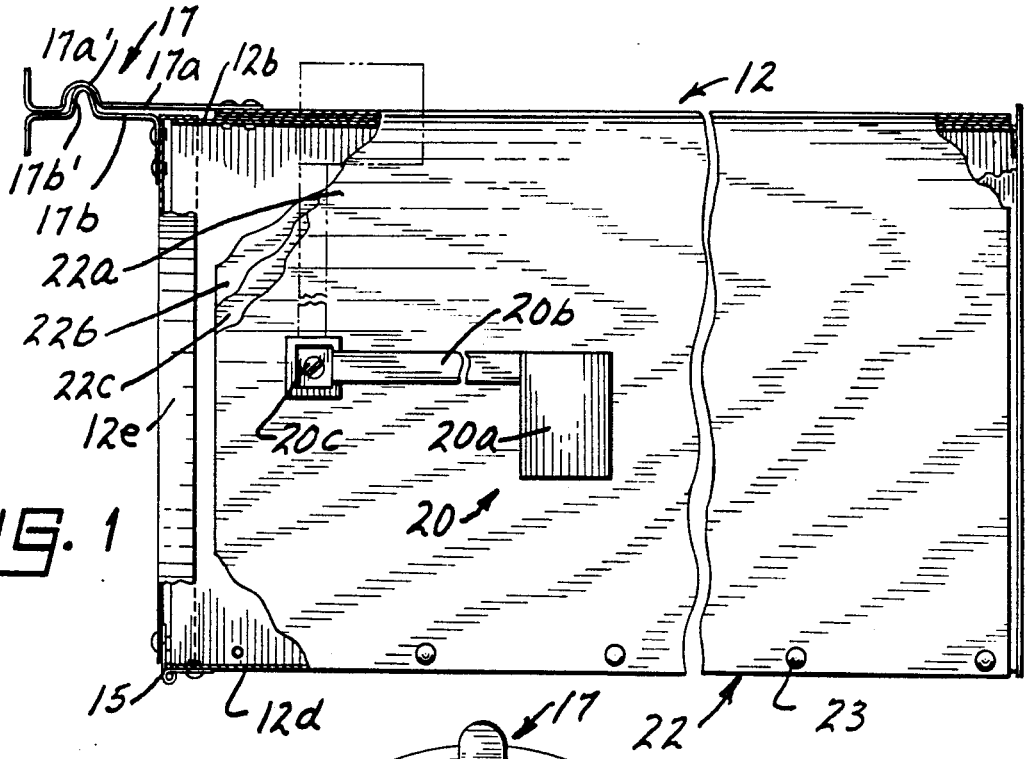
FIG. 1
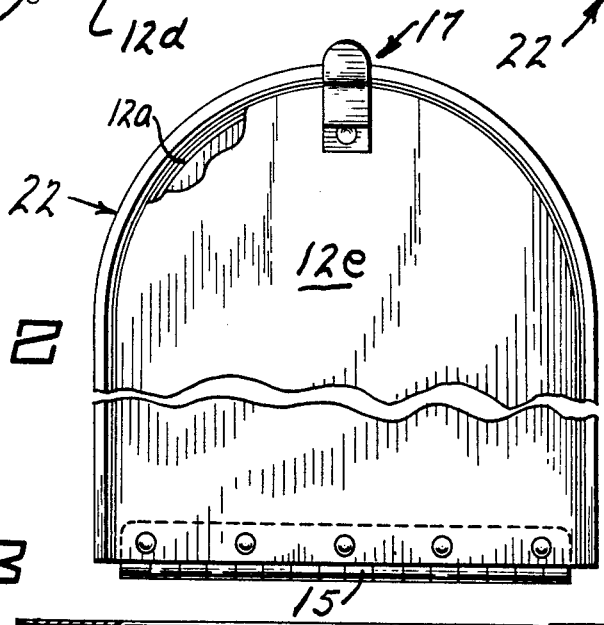
FIG. 2
FIG. 3
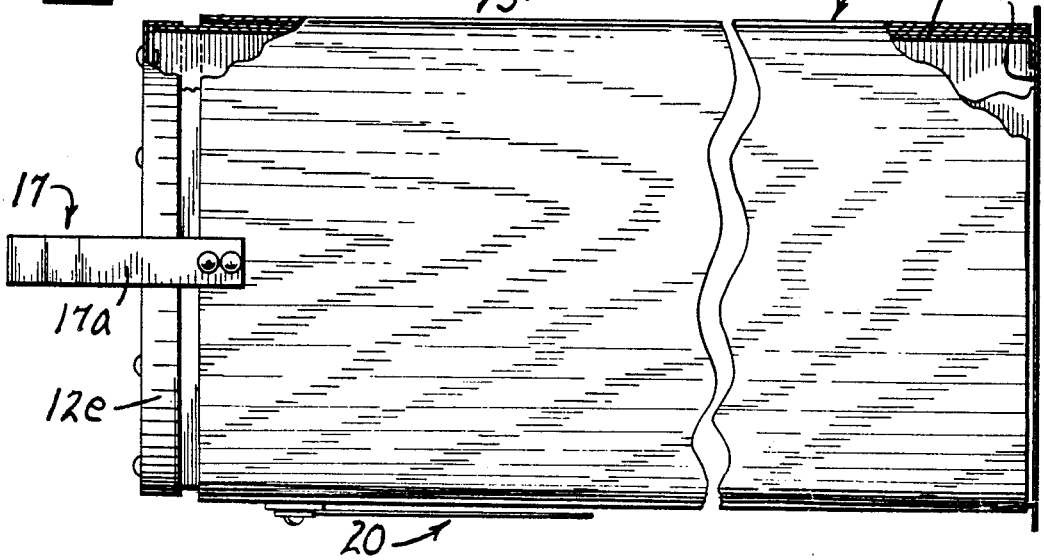

MAIL BOX STRUCTURE

As is known, the need for freestanding mail boxes is widespread, extending from rural to suburban areas, where such, typically, are characterized by a metal housing having a pivotal entry or door, and a movable arm for signaling purposes. Usually, the mail boxes are made from unornamented sheet metal; however, personalized mail boxes, i.e. depicting wild life, dogs or the like, and silk screened, for example, on a painted surface, are also available. The latter personalized mail boxes are generally desirable for adding a decorative touch and/or charm to a neighborhood.

Since, and as stated, standard mail boxes are commonly made from sheet metal, such, therefore, present poor weathering characteristics, and, for example, are affected by rusting and/or other like unsightliness. A need has arisen, therefore, for a mail box which serves both durability in use, and, as well, a pleasing appearance.

The invention satisfies the aforesaid requirements in presenting a mail box encased, over the main body portion thereof, by a thin decorative exterior grade and preservative treated plywood. The plywood is wrapped around the outside of the mail box, being flexible, but dimensionally stable and strong, and serving not only a decorative function but, as well, maintaining a resistance to adverse weather conditions.

In the practice of the invention, certain perameters require attention as, for example, the thickness of the veneer; the number of plies involved; the adhesive employed; the orientation of the veneer grains; and, the possible use of plies other than wood veneer. Typically, the mail box presented by the inventionincludes a body or housing defined by an arcuate top portion blending into side walls; a pivotal entry door; a rear wall; a bottom wall or base; and, conventional latching mechanism.

In any event, a better understanding of the present invention will become more apparent from the following description, taken in conjunction with the accompanying drawing, wherein FIG. 1 is a view in side elevation, partly fragmentary, showing a mail box structure in accordance with the teachings of the present invention;

FIG. 2 is a view in end elevation, looking from left to right in FIG. 1, further illustrating the instant mail box; and, FIG. 3 is a top plan view, even further detailing the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

Referring now to the figures, a conventional rural or suburban type mail box 12 is disclosed, such being characterized by a housing **12*a* having an arcuate upper portion 12*b* blending into side walls 12*c*; a base or bottom wall 12*d* to which the side walls 12*c* are secured; an entry door 12*e* conventionally pivoted, at hinge 15, to the undersurface of the base or bottom wall 12*d*; a rear wall 12*f*: and, a common type latching mechanism 17, including cooperating forwardly extending arms 17*a* and 17*b*, respectively secured to the mid-region of upper portion 12*b* of the housing 12*a* and to the upper mid-area of the entry door 12*e*. The arms 17*a* and 17*b* each include a projection 17*a*' and 17*b*'**, respectively, where the latter, when in a nesting relationship, achieve desired latching.

In addition, and as customary, the mail box 12 includes, along a side wall **12*c* of the housing 12*a*, a signaling device 20, as a flag 20*a* disposed on an arm 20*b* pivotal, at 20*c*, from the solid line position of FIG. 1 to the phantom line position of such figure, and conversely. The latter arrangement serves to indicate the need for mail service. The aforedescribed mail box structure is made from sheet metal, where the invention comes into play with respect to the housing 12*a*.**

In this connection, the invention presents the encasement and/or the overlaying of the housing **12*a* with thin decorative exterior grade and preservative treated flexible plywood 22, typically positioned through, for example, mechanical fasteners, such as conventional rivets. While the invention utilizes plywood 22, in multi-layers 22*a*, 22*b* and 22*c*, or laminated wood, such material, in and of itself, has a long and varied history of usage, but not as presented in the application herein, i.e. in wrapping around the outer surface of a housing 12*a*** of a rural or suburban style mail box. In other words, the face ply of real wood veneer serves a decorative function and, importantly, is selected from a species of wood that weathers well and is decay resistant. The veneer is selectively thin cut so as to afford the needed flexibility for wrapping purposes.

In order to achieve the desired aforesaid flexibility, including rigidity and strength required by the instant use, certain factors play importance, including the aforementioned veneer thickness, the number of plies, the plywood adhesive employed, the veneer grain orientation, and the use of plies made from other than wood veneer.

As a matter of background, and as to the number of plies aspect, any given plywood 22 may be defined by two or more plies, where the grain orientation is typically 90° from ply to ply. The plies involved are variously defined as a face ply, a back ply, a core and a crossband(s), where balanced plies and crossband grains serve to impart dimensional stability to the employed plywood.

In other words, three-ply construction is superior to two-ply construction, and while the plies may be wood veneers, other usable material includes natural fiber products, such as cotton, canvas, linen, and muslin, or even synthetic woven or non-woven fabrics, such as nylon, polypropylene, polyethylene, fiberglass, and the like.

The plywood and/or veneer is preservative treated, as by the use of, for example, a mildewcide, fungicide, insecticide, and/or water repellant, each serving to extend the life of the plywood 22 for outdoor exposure. The veneers are usually treated after lamination into the form of plywood, where such treatment can be accomplished by either spray, brush, roller, pressure or dip-/immersion.

After preservative treatment, the wooden face veneer can be provided with added decorations, logos and the like, being painted, embossed, engraved or otherwise marked onto the plywood 22. Typically, the finish for the plywood 22 is a transparent stain, a chemical preservative made from common commercial off the shelf ingredients, or, further, a substance such as an epoxy, a urethane or another exterior varnish. It should be noted that both sides of the plywood 22 must be finished to prevent possible distortion caused by unequal absorption of atmosphere humidity or water into the plywood.

On the other hand, and as to affixing the flexible plywood 22, after wrapping, onto the mail box housing 12*a*, mechanical fasteners, such as pop or simple rivets 23 may be employed for fastening purposes, or materials such as glues, adhesives, mastics or the like.

From the preceding, it should be evident that the choice and/or selection of plywood herein affords durability and, as well, a decorative effect, for a common mail box structure, where the wood grain may be displayed by itself or as a background for any other desired ornamentation. The invention, therefore, adds a new dimension to rural mail box presentation, effectively serving both utilitarian and appearance purposes.

The mail box structure described herein is susceptible to various changes within the spirit of the invention, i.e. other than those already mentioned, including proportioning, the amount of housing coverage, and the like. Thus, the preceding should be considered illustrative and not as limiting the scope of the following claims.

I claim:

1. A mail box structure comprising a housing defined by an arcuate upper portion blending into side walls, a bottom wall, a back wall, an entry door, a latching mechanism cooperable between said housing and said entry door, a unitary sheet of thin flexible plywood presenting dimensionally stable and strong physical properties overlying said housing in a conforming and engaging relationship, and means securing said unitary sheet of thin flexible plywood to said housing.

2. The mail box structure of claim 1 where said unitary sheet of thin flexible plywood is characterized as a decorative exterior grade type.

3. The mail box structure of claim 1 where said unitary sheet of thin flexible plywood is preservative treated.

4. The mail box structure of claim 1 where said means is a mechanical fastener.

5. The mail box structure of claim 1 where said means is an adhesive.

* * * * *